United States Patent [19]

Jarvis et al.

[11] Patent Number: 5,001,801

[45] Date of Patent: Mar. 26, 1991

[54] OSCILLATING LINE TRAVEL PIPE CLEANING MACHINE

[75] Inventors: Harold F. Jarvis, Moffat; Carlos Sinforoso, Rexdale, both of Canada

[73] Assignee: Shaw Industries Ltd., Rexdale, Canada

[21] Appl. No.: 345,237

[22] Filed: May 1, 1989

[30] Foreign Application Priority Data

May 4, 1988 [CA] Canada ..... 565889

[51] Int. Cl.[5] ..... B08B 9/02

[52] U.S. Cl. ..... 15/93.1; 15/88; 15/104.04; 29/81.05; 29/81.11; 29/81.13

[58] Field of Search ..... 15/88, 104.04, 93 R; 51/80 R, 80 A; 118/DIG. 11; 29/81 F, 81 G., 81 H; 83/743, 745

[56] References Cited

U.S. PATENT DOCUMENTS 3,797,060 3/1974 Salukvadze et al. ..... 15/104.04 X 4,771,499 9/1988 Fusi et al. ..... 15/88

FOREIGN PATENT DOCUMENTS 988403 5/1976 Canada ..... 15/88

0971536 11/1982 U.S.S.R. ..... 15/104.04

*Primary Examiner*—Edward L. Roberts

*Attorney, Agent, or Firm*—Ridout & Maybee

[57] ABSTRACT

A self-propelled pipe cleaning machine as disclosed for use in removal of deteriorated coatings, such as coal tar or tape, from pipelines and providing a degree of surface preparation suitable for recoating. The machine comprises a travelling frame for motion along the pipe and an oscillating carriage bearing a plurality of counter-rotating cylindrical cutting tools which are urged toward the pipe surface by constant-force pneumatic cylinders. Variation in the pressure of cutters against the pipe surface during oscillation of the cutter head is avoided by counterbalancing of the pivotally-mounted cutters and their associated drive means.

6 Claims, 6 Drawing Sheets

Figure 1:
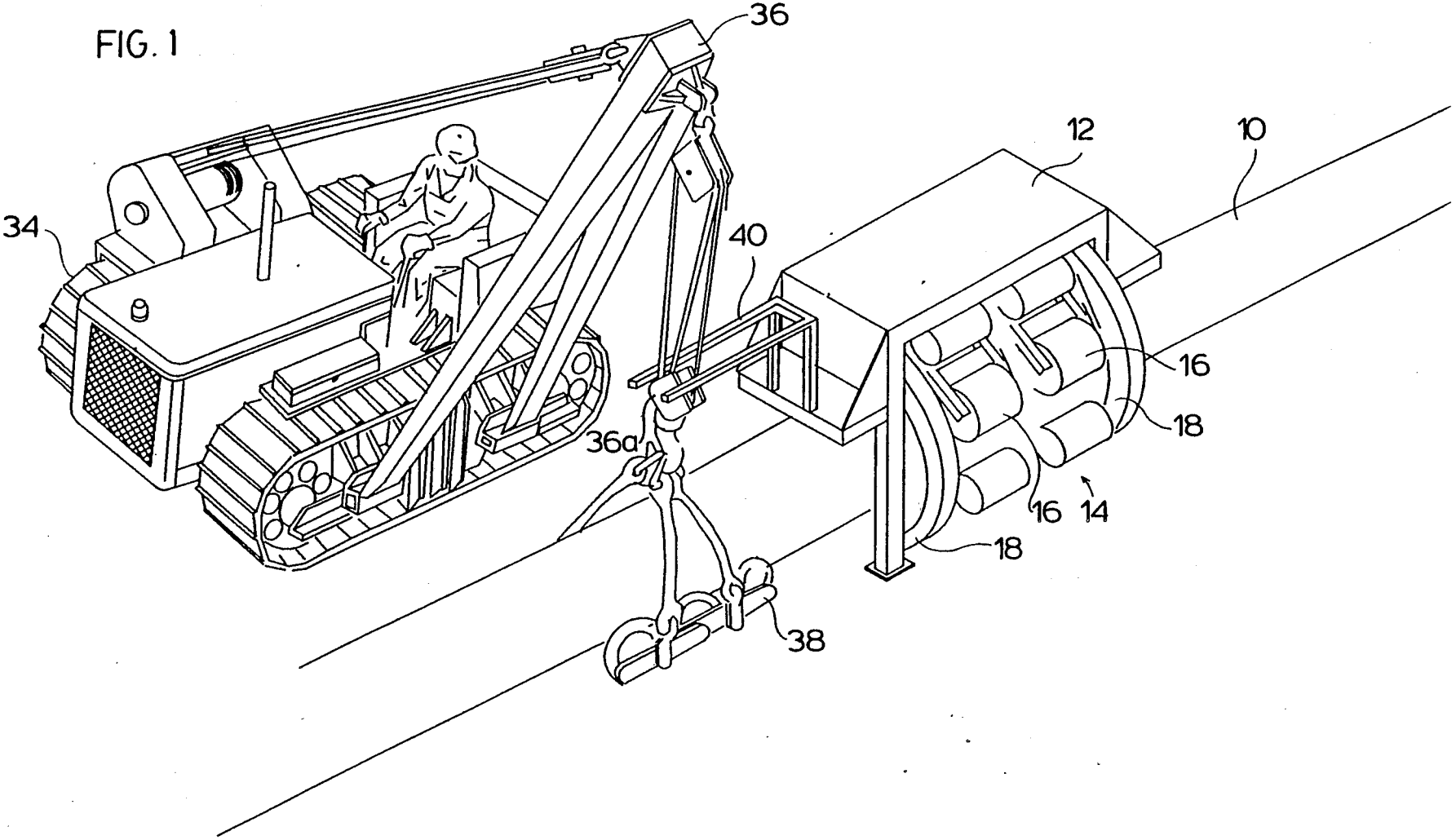

FORCE WT 1 = MOTOR WEIGHT
FORCE WT 2 = TOOL WEIGHT
DISTANCE X = C.G. OF MOTOR TO PIVOT POINT
DISTANCE Y = C.G. OF TOOL TO PIVOT POINT
WT 1 x X = WT 2 x Y IN ALL POSITIONS

OSCILLATING LINE TRAVEL PIPE CLEANING MACHINE

This invention relates to apparatus for removing a wide variety of pipeline coatings, preparatory to recoating of the pipeline.

The need for methods of rehabilitating existing pipelines has increased in step with the failure or inadequate performance of existing coatings which have been in service for extended periods of time. The failure of protective pipe coatings over time arises from moisture absorption, soil stress and other environmental factors. At locations on the pipe where adhesion of coating is lost, there can result pitting of the pipe surface and eventual stress corrosion cracking.

A major problem in the maintenance and rehabilitation of pipeline is the removal of the original coating system, particularly where that coating contains soft and sticky components such as coal tar enamel, or the various adhesives used in protective tape wrappings. Such components, to a large degree, continue to stick to the pipe surface after coating failure and are resistant to removal by conventional means such as mechanical scrapers, knives or brushes. Such means are more or less successful with hard and brittle coatings, but tend to clog or smear sticky coating residue, so that the pipe surface is not left in a condition suitable for recoating. Grit blast cleaners of the kind in which abrasive grit is hurled at the pipe surface to prepare a clean finish for coating are not suitable or effecient in the removal of failed pipeline coatings.

It has been found that removal of pipeline coatings, including coal tar enamel and adhesive-backed plastic tape systems can be achieved by use of a cleaning machine in which a plurality of counter-rotating carbide-tipped tools are mounted to an oscillating head embracing the pipe, and which is operable at the same time to travel along the length of the pipe. Such a machine can be designed to effect a positive, gentle milling operation on the pipe surface to remove the coating efficiently and at relatively low power consumption.

A particular advantage of a pipe cleaning machine as described and claimed herein is that its design and manner of operation allows it to be used in the field to clean an uncovered ("daylighted") section of pipeline, for example natural gas pipeline, without the requirement of removing the pipeline section from the ditch in which it is seated. Such in-ditch treatment of pipe systems is referred to hereinafter as a "bell-hole" operation, referring to the sectional appearance of the ditch dug to uncover the pipe.

The present invention is a self-propelled pipe cleaning machine, comprising in combination:

a travelling frame having traction means for motion of the frame along the pipe;

variable speed drive means on the travelling frame for driving said frame along the pipe;

an oscillating carriage comprising a pair of part-circular frames mounted to and transported by the travelling frame at either end thereof surrounding and radially spaced from the pipe, and operable to oscillate angularly relative to the travelling frame about the central axis of the pipe between two selected limiting positions;

drive means for powering the oscillating movement of said oscillating carriage;

on each of said part-circular frames, a plurality of assemblies of rotatable cylindrical cutting tools and individual drive means therefor, each assembly being pivotally mounted about its centre of gravity to said part-circular frame, at regular angular spacings therealong no greater than the angular spacing between said limiting positions of oscillation, so that in operation each of said cylindrical cutting tools is in rolling contact with the surface of the pipe; and means for urging the cutting tools radially toward the central axis of the pipe against the surface thereof with a selected uniform applied force to effect abrasion of the pipe surface by the rotating cylindrical cutting tools as they oscillate with said part-circular frame.

Figure 2:
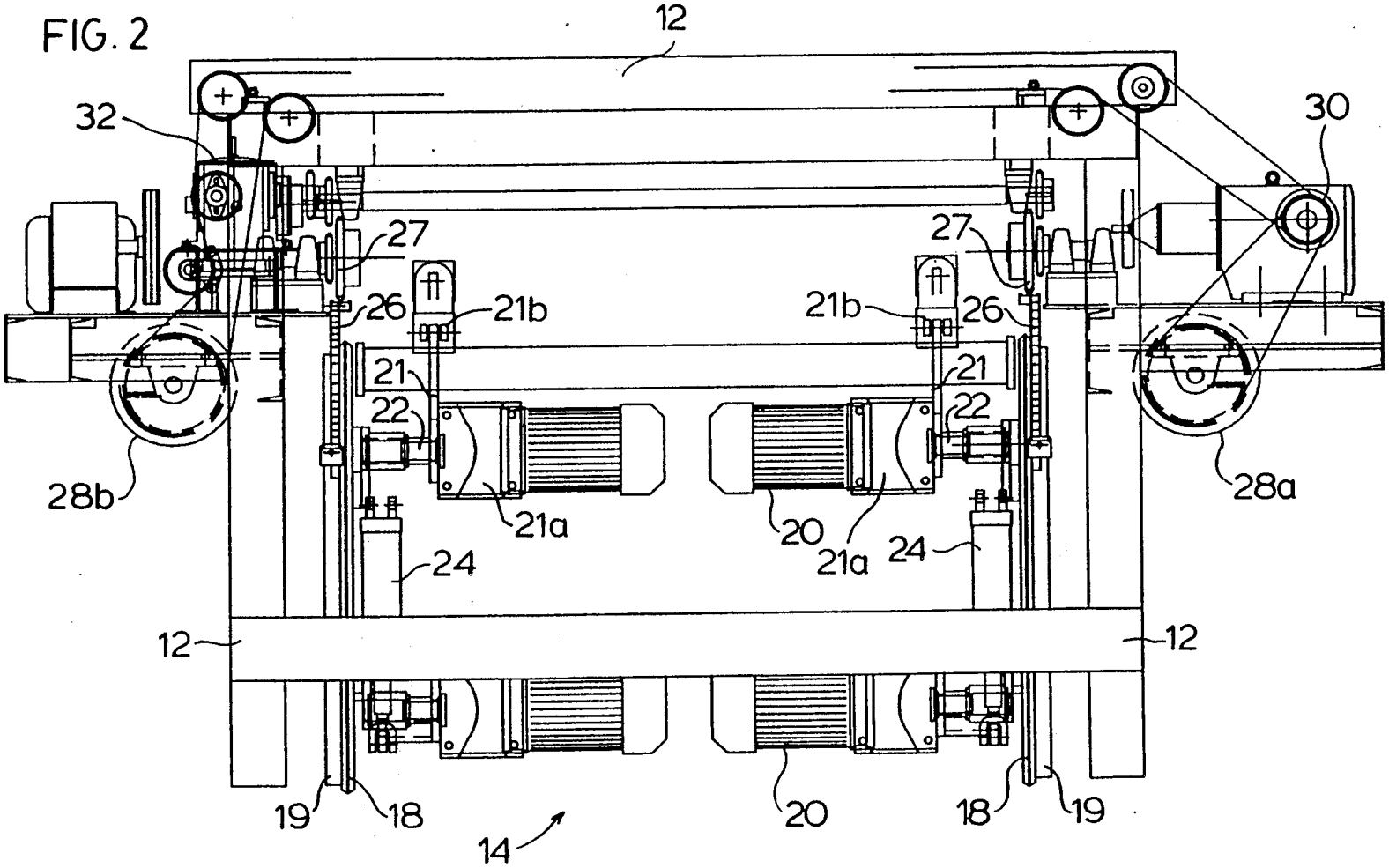
Figure 3:
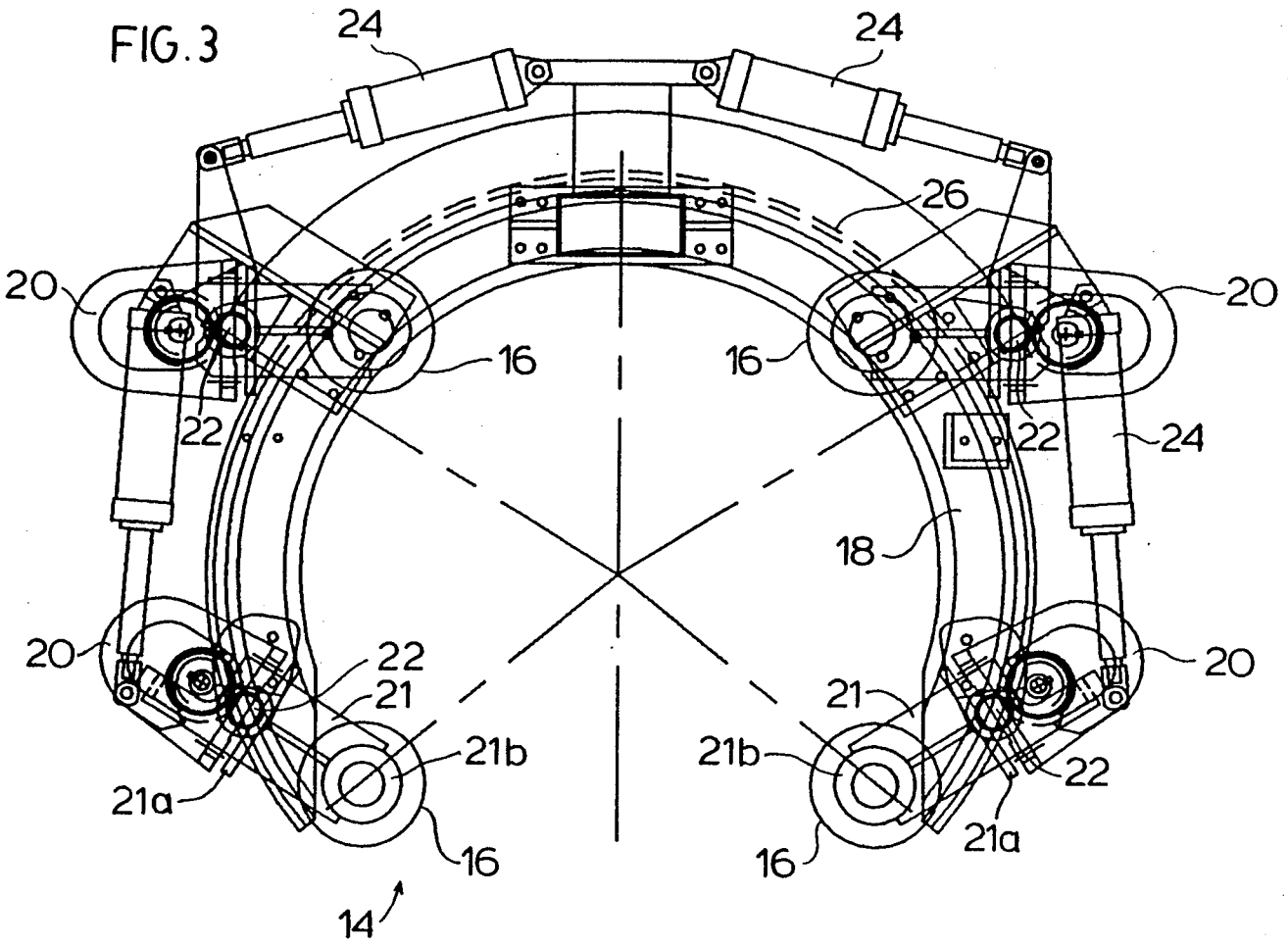
Figure 4A:
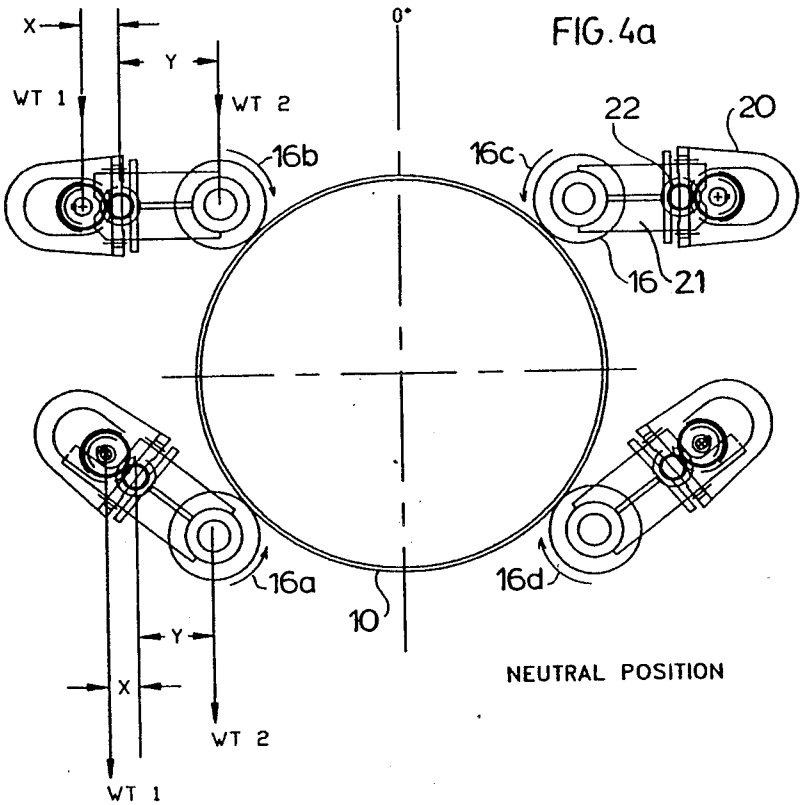
Figure 4B:
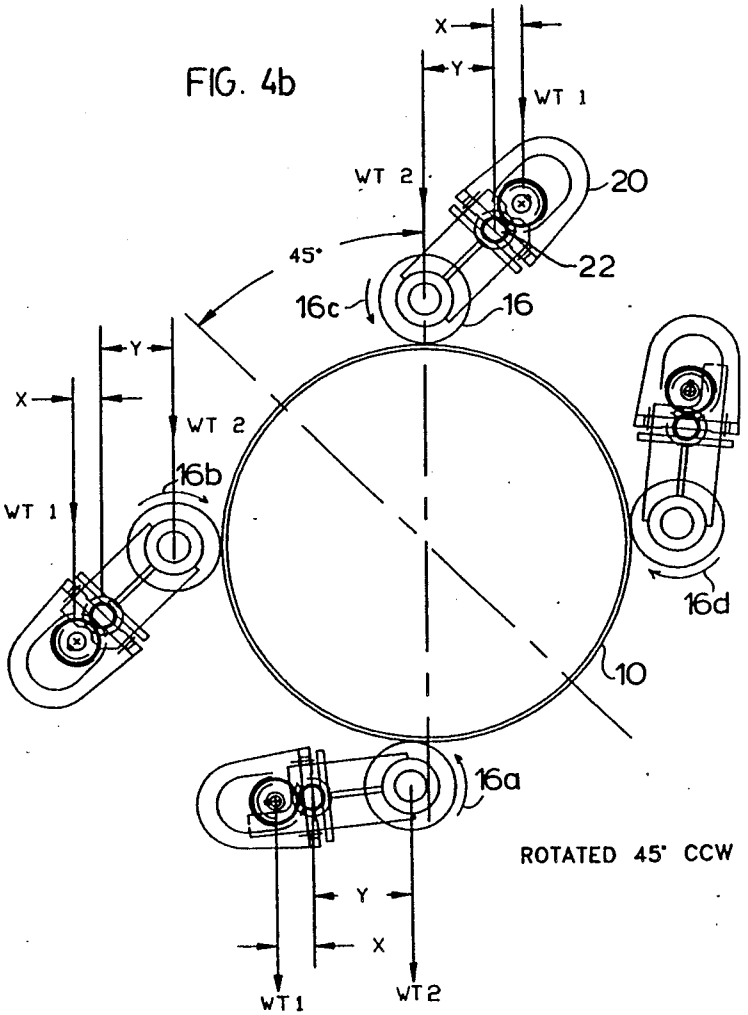
Figure 7:
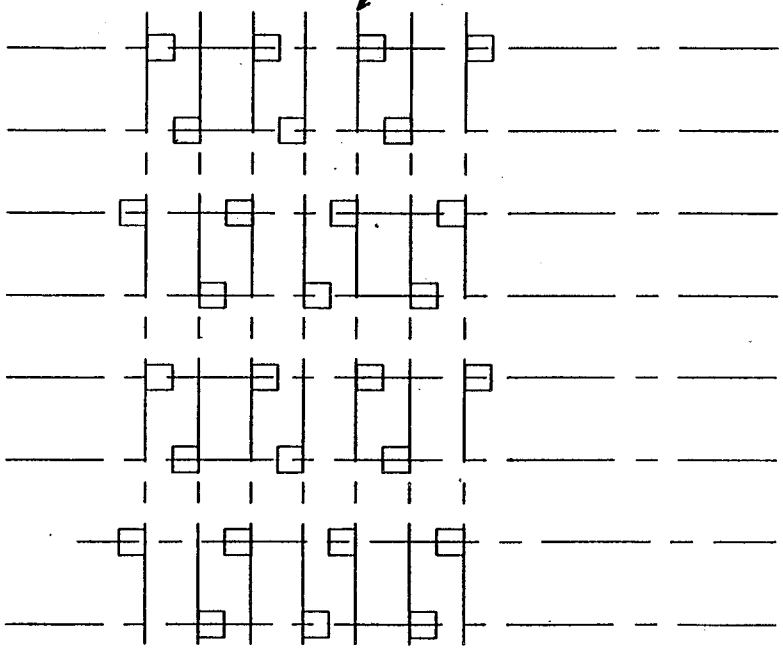
Figure 5:
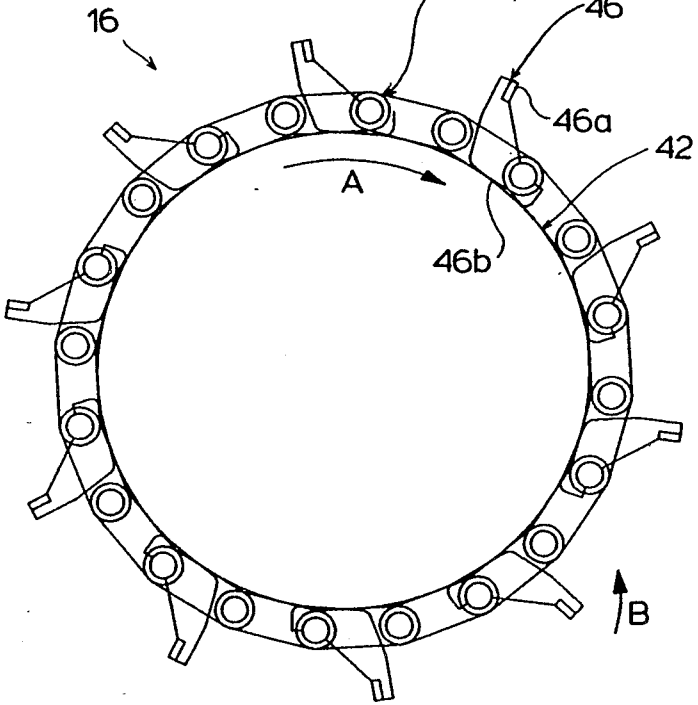
Figure 6B:
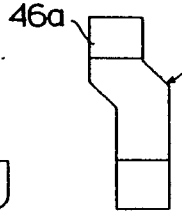
Figure 6A:
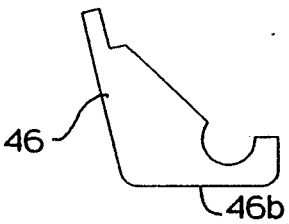
Figure 8:
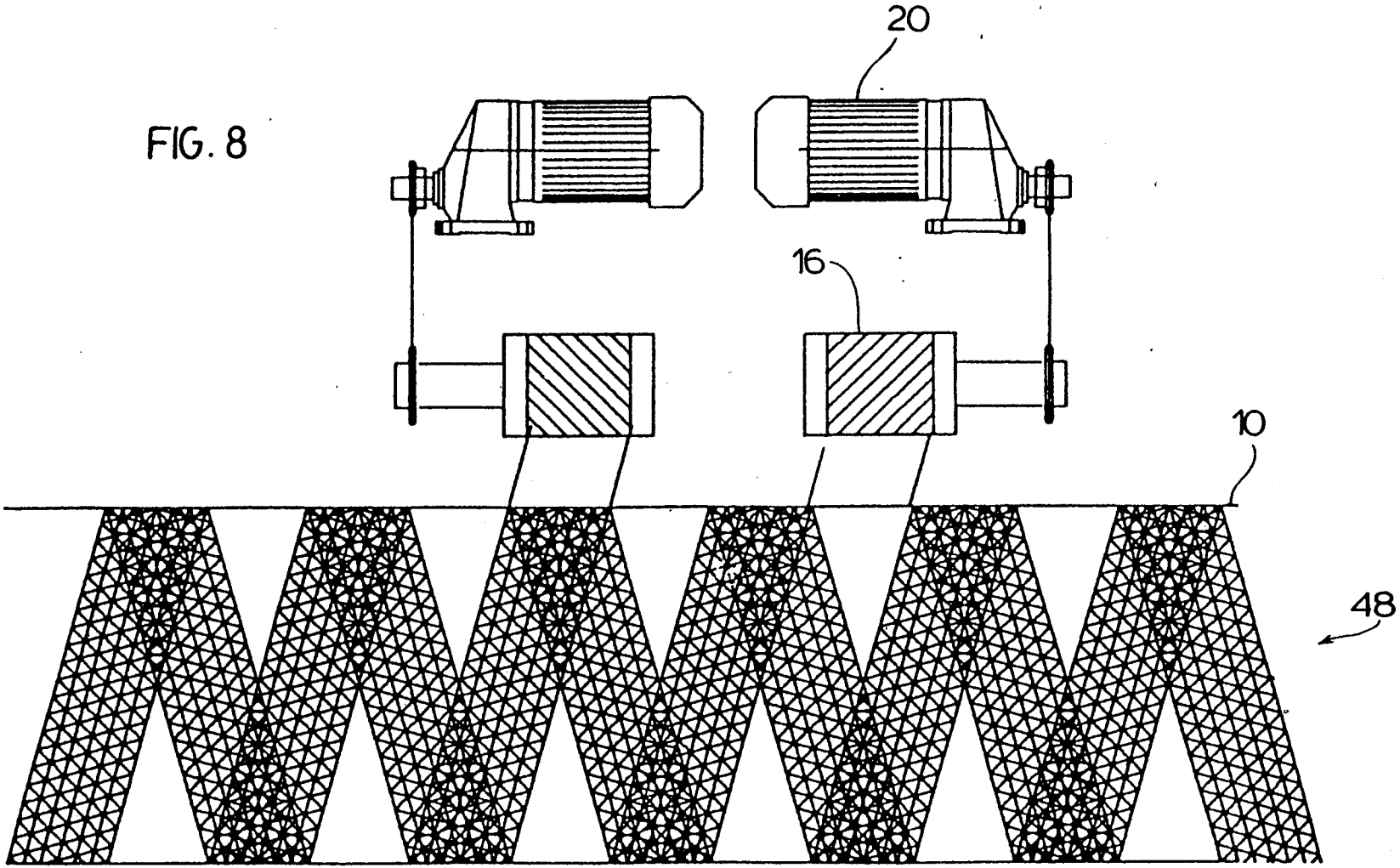

The invention will now be described, by way of example only, with respect to the accompanying drawings in which, FIG. 1 schematically illustrates the use of a cleaning machine according to the invention, in conjunction with pipe-lifting apparatus mounted to the sideboom of a tractor, for cleaning a section of pipeline in a bell-hole operation, FIG. 2 is a side elevational view of an oscillating line travel machine according to one embodiment of the invention, FIG. 3 is the front elevational view as seen from the right of FIG. 2, but with the line travel frame and associated components removed to show more clearly the oscillating head and its associated elements, FIGS. 4*a* and 4*b* are illustrations of two different oscillatory positions of the cutting tool and motor assemblies about a pipe section being cleaned, illustrating how constancy of cutting tool force independent of tool position is achieved, FIG. 5 is an end view of a cylindrical toothed cutting tool which may be used in a pipe cleaning machine according to the invention, FIGS. 6*a* and 6*b* are detailed views of a single tooth of the cutting tool of FIG. 5, FIG. 7 schematically illustrates the alternating tooth pattern of successive lines of teeth along the length of the cylindrical cutting tool of FIG. 5, and FIG. 8 illustrates the cutting pattern made on a pipe subjected to the operation of a pipe cleaning machine according to the invention, equipped with a cutting tool having an alternating tooth pattern as illustrated in FIG. 8.

Referring to FIGS. 1, 2 and 3, a particular embodiment of the insulating line travel machine for cleaning a pipe indicated at 10 consists of a line travelling frame and an oscillating head carried thereon, illustrated generally at 12 and 14, respectively.

As best seen in FIGS. 2 and 3, in the oscillating head of the pipe cleaning machine, cylindrical cutting tools 16 are mounted to each of two opposed C-shaped end plates 18, disposed at opposite ends of the oscillating head 14. Firmly affixed to respective upper portions of the perimeter of each oscillating plate 18 is a portion of chain track 26, the links of which engage with respective driven sprocket wheels 27. Each of the C-shaped end plates 18 is rotatable with respect to a part-circular member 19 along roller bearings or the like (not shown) between them. Member 19 is rigidly mounted to the travelling frame 12. The drive mechanism for osicillating C-shaped end plates 18 (in conjunction with the associated components of the oscillating head 14) relative to members 19 of the travelling frame 12 and for simultaneously moving the travelling frame 12 along the pipe in an embodiment of the invention is further discussed below.

As best seen in FIGS. 3, 4*a* and 4*b*, in the illustrated embodiment of the invention four cylindrical cutting tools 16*a*, 16*b*, 16*c* and 16*d* are mounted at 90° intervals about each associated end plate 18 of the oscillating head. Each tool is individually driven by an electric motor 20, through conventional chain-and-sprocket linkages. Each such tool/motor pair is affixed to a mounting bracket, indicated generally at 21, which can pivot about pivot pin 22, located at the centre of gravity of the assembly of tool, motor drive and mounting bracket. This has effect of countering gravitational imbalance of the radially inward force of the cutting tool against the pipe surface, as illustrated in and discussed below in connection with FIGS. 4*a* and 4*b*. Mounting bracket 21 comprises a base plate portion 21*a* to support the motor drive 20 and a collar or bushing portion 21*b* to support the drive shaft of the cylindrical cutting tool 16.

Cutting tools 16 are urged radially inwards against the surface of pipe 10 by pneumatic cylinders 24 connected to tool drive bases 21, as illustrated in FIG. 3. The pneumatic actuation system is self-relieving so that variation in the force exerted on the cutting tool is eliminated.

In operation, as the line travelling frame 12 moves along the pipe, end plates 18 of the oscillating head are rotationally oscillated together around pipe 10 as drive supplies torque, through drive sprockets 27, to the chain track sections 26 affixed to the respective upper perimeters of C-shaped end plates 18. It will be readily seen that the total angle of oscillation must be no less than the angular spacing between successive cutters, if complete coverage of the pipe surface is to be ensured. With the arrangement of four cutting tools at right angles around the pipe, an oscillation angle of between 94° and 98° is preferred.

Travelling frame 12 moves along the pipe on front and rear driven traction wheels 28*a* and 28*b*, respectively, which are contoured to engage the upper surface of the pipe being cleaned. Preferably, both the oscillating motion of the tool head and travel along the line are powered by a single, variable-speed electric motor operatively connected to line drive transmission 30 and the reversing transmission for oscillation The reversing transmission consists of a gear box 32 and clutches (not shown) which are powered by drive 30. The reversing transmission utilizes two electrically operated clutches which receive signals from limit switches placed on the oscillating head assembly 14. Oscillating motion results from energizing one or the other clutch, depending upon the tool location on pipe 10. By the expedient use of a single control for both modes of motion, the rates of travel and angular oscillation remain in a fixed ratio at all speed settings, so that the cutting pattern of the cutting tools on the surface of the pipe does not vary.

Referring specifically to FIG. 1, the use of a machine according to the invention in a bell-hole operation employs a leading tractor 34, which is driven above and to the side of the ditch in which the pipe 10 is located. The bottommost cutter/drive motor assemblies of the cleaning machine are readily temporarily removed from their respective pivot pins, thereby clearing the gaps in the part-circular end plates, so that the cleaner may be lowered onto the pipe.

The tractor 34 is equipped with a sideboom 36, from which hangs a wheeled cradle 38, supporting the pipe from beneath as the tractor moves forward ahead of the self-propelled travelling line frame 12 of the cleaning machine. Maintenance of centering of the cleaning machine on pipe 10 is accomplished by running with block 36*a*, suspended from the sideboom, between horizontal extensions of a bridle 40 mounted to the line travel frame 12. The degree of cleaning of the pipe surface can be varied by adjusting the speed of line travel and oscillation, and the tool pressure through a change of setting in the pneumatic cylinders.

FIGS. 4*a* and 4*b* show, respectively, the relative positions of the cutting tools at the mid-point of oscillation and at the counterclockwise extreme (for 90° total oscillation). These figures and the annotations thereto show how the aforementioned mounting of each cutting tool/motor pair on a base 21 pivoting about the centre of gravity of the entire tool and motor drive assembly eliminates the effects of gravity on the tools when cycling the tool head around pipe 10.

Because the pneumatic actuator system including cylinders 24 is self-relieving about a pre-selected pressure, the tool force is maintained constant in the face of surface irregularities or eccentricity of the pipe surface.

FIG. 4*a* also illustrates schematically, how adjacent pairs of cutting tools are preferably counter-rotated to reduce or eliminate any net torque reaction (spinning moment) on the pipe 10. Thus, as indicated by the curved arrows, diametrically opposed cutters 16*a* and 16*c* are rotated in a sense tending to induce clockwise rotation of the pipe 10, while cutters 16*b* and 16*d* are rotated in the offsetting direction.

Stability and uniformity of the cleaning action are thus optimized by the balanced drive assemblies eliminating gravitational effect on tool force, by counter-rotation of the cylindrical cutting tools to eliminate torque reaction, and by actuation of pressure of the cutting tools against the pipe surface through the agency of an arrangement of self-relieving pneumatic cylinders, assuring substantially constant force on an uneven pipe surfaces, e.g., pipe sections presenting surface welds. Moreover, the arrangement of tool/motor assemblies as part of the oscillating head results in a great portion of the weight of the pipe cleaning machine being cradled around the pipe, with a consequently low centre of gravity and improved travel stability fo the line travel frame 12.

A special carbide-tipped cutting tool 16 adapted for use in the pipe cleaning machine of the invention is illustrated in FIGS. 5, 6*a*, 6*d* and 7. A cylindrical rubber core 42 is tightly encircled by parallel rows of roller chain 44, each of which has a plurality of teeth 46 with carbide tips 46*a*, pivotally mounted regularly along the length of chain. Arrow A shows the direction of rotation of the cutting tool and arrow B the opposite sense in which each tooth 46 pivots as it engages the surface of the pipe. That pivoting motion is resisted by the resilient force of the rubber core 42 against the base 46*b* of the tooth.

As seen in the front view of a tooth in FIG. 6*b*, each tooth is laterally offset about a portion 46*c*, so that its tip lies outside the central plane of circular chain 44. The direction of offset alternates from one tooth to the next. As schematically illustrated in FIG. 7, the tooth pattern thus alternates along the centre line 44*a* of each roller chain. The tooth pattern of several adjacent roller chains is shown in FIG. 7, illustrating the tooth-blank-tooth pattern of alternation along lines parallel to the cylindrical core axis.

FIG. 8 illustrates the cutting pattern 48 formed on a surface of a pipe 10 cleaned by an oscillating line travel pipe cleaning machine in which such cylindrical cutting tools are installed. Two of the tool/motor drive assemblies including a cutting tool 16 and a drive motor 20 are shown. The diagonal lines 50 appearing on the surface of the cutting tool represent diagonal lines defined by the staggered tooth pattern of FIG. 7.

It will be appreciated that a number of possible cylindrical cutting tools might be used in connection with the oscillating head of a pipe cleaning machine constructed according to the invention. The tool illustrated and described herein has been found effective in the removal of deteriorated pipe coatings to provide a surface preparation suitable for recoating.

Those skilled in the art will also appreciate that other variations of the specific embodiments of the invention shown and described above may be made, without departing from the scope of the invention, which is defined in the claims annexed hereto.

We claim:

1. A self-propelled pipe cleaning machine, comprising in combination:

a travelling frame including traction means for motion along the pipe;

variable speed drive means on the travelling frame for driving said frame along the pipe;

an oscillating carriage comprising a pair of part-circular frames mounted to and transported by the travelling frame at either end thereof surrounding and radially spaced from the pipe, and operable to oscillate angularly relative to the travelling frame about the central axis of the pipe between two selected limiting positions;

drive means for powering the oscillating movement of said oscillating carriage;

on each of said part-circular frames, a plurality of assemblies of rotatable cylindrical cutting tools and individual drive means therefor, each such assembly being pivotally mounted about its centre of gravity to said part-circular frame, at regular angular spacings therealong no greater than the angular spacing between said limiting positions of oscillation, so that in operation each of said cylindrical cutting tools is in rolling contact with the surface of the pipe; and means for urging the cutting tools radially toward the central axis of the pipe against the surface thereof with a selected uniform applied force to effect abrasion of the pipe surface by the rotating cylindrical cutting tools as they oscillate with said part-circular frame.

2. A pipe cleaning machine according to claim 1, wherein said means for urging the cutting tools against the surface of the pipe comprises an assembly of self-relieving pneumatic cylinders mounted to said travelling frame and articulately interconnected with said assemblies of cutting tools and drive means.

3. A pipe cleaning machine according to claim 1, wherein said plurality of assemblies consists of four such assemblies equiangularly disposed about said part-circular frame, the total angle of oscillation being 90° or greater.

4. A pipe cleaning machine according to claim 3, wherein the total angle of oscillation is between about 94° and about 98°.

5. A pipe cleaning machine according to claim 1, wherein said means on the travelling frame for driving said frame along the pipe and said means for powering the oscillating movement of the oscillating carriage jointly comprise a single, variable-speed electric motor and associated transmission means operable to increase or decrease the speed of line travel and the rate of oscillation simultaneously in a fixed selected ratio.

6. A pipe cleaning machine according to claim 1, wherein the cylindrical cutting tools of neighbouring assemblies on either of said part-circular frames are operable to rotate in opposite directions from each other.

* * * * *